US005651713A

United States Patent [19]

Lee et al.

[11] Patent Number: 5,651,713

[45] Date of Patent: Jul. 29, 1997

[54] METHOD FOR MANUFACTURING A LOW VOLTAGE DRIVEN FIELD EMITTER ARRAY

[75] Inventors: Jong Duk Lee, Department of Electronics Engineering, College of Engineering, Seoul National University, Shin Lim-dong, Kwanak-ku; Cheon Kyu Lee; Ho Young An, all of Seoul, Rep. of Korea

[73] Assignees: Korea Information & Communication Co., Ltd.; Jong Duk Lee, both of Seoul, Rep. of Korea

[21] Appl. No.: 538,986

[22] Filed: Oct. 5, 1995

[30] Foreign Application Priority Data

Dec. 10, 1994 [KR] Rep. of Korea ..... 1994-33634

[51] Int. Cl.[6] ..... H01J 9/02; H01J 1/30

[52] U.S. Cl. ..... 445/50; 313/336

[58] Field of Search ..... 445/50, 51; 313/309, 313/336

[56] References Cited

U.S. PATENT DOCUMENTS 5,228,878 7/1993 Komatsu ..... 445/50

5,401,676 3/1995 Lee ..... 445/50

*Primary Examiner*—David L. Pirlot
*Assistant Examiner*—Jeffrey T. Knapp
*Attorney, Agent, or Firm*—Dilworth & Barrese

[57] ABSTRACT

The present invention provides a method for manufacturing a low voltage driven field emitter array, comprising steps of forming a thin buffer layer on a silicon substrate, making a pattern with lots of silicon nitride masks on the layer, oxidizing the upper part of the substrate and forming a relatively thick oxide layer onto the substrate except the part under the nitride masks, during which the thick oxide layer upheaves the edges of the nitride masks and extends inwardly under the nitride masks so that the edges of the thick oxide layer under the nitride masks may have a kind of bird's beak shape in cross section, etching away the nitride mask pattern, exposing the silicon substrate for the circular parts surrounded by the bird's beak shape edges by etching away the thin buffer layer, etching away the exposed substrate for making gate holes of undercut shape, and forming metal layers on the substrate and the bottom of the gate holes by evaporating a matalic evaporant downwardly and vertically against the surface of the substrate. The diameter of the gate hole is reduced in comparison to that defined by the photomask and the FEA may be driben at relatively lower voltages.

6 Claims, 3 Drawing Sheets

METHOD FOR MANUFACTURING A LOW VOLTAGE DRIVEN FIELD EMITTER ARRAY

BACKGROUND OF THE INVENTION

The present Invention relates to a method for manufacturing a low voltage driven field emitter array, and more particularly, to a method for manufacturing a low voltage driven field emitter array with gate holes of smaller diameters than those defined by photomask.

Field emission display (FED), as a kind of flat panel displays, has been object of active developments for reseachers and laboratories over the world. A field emitter array (FEA) functions with its cathode and gate and the development of LOW voltage driven FEA holds the key to success or failure of FED.

Emission current of a field emitter increases as the electric field applied to its cathode tip, that is, the field emitting tip, by its gate electrode to which a relatively positive(+) voltage is applied, has increased. Because the strength of the electric field applied to the cathode tip is in inverse proportion to the size of the gated field emitter [N. E. McGruer and Z. Huang. IVMC '93 Technical Digest, P. 135 (1993)], the smaller the size of the device is, the lower its driven voltage gets.

Further, as the size of the emitter tips as the source of emission of electrons gets smaller, the packing density of the field emitters can be increased, resulting in the lowered driving voltage of the FEA.

Therefore, studies for reducing the size of field emitter have long been under way, but there exist some limitations on reducing the diameter of the gate hole by photomask works, including one as used in so-called Spindt process.

The essential part of the Spindt process is to form a pattern of gate holes with a diameter of about 1 μm and photomask aligner, electron beam lithography, or ion beam lithography equipment is used to form the gate hole pattern on the photoresist layer.

When using the photomask aligner, it is possible to form the number of gate hole patterns over the whole substrate at a time, but hard to obtain the pattern of the gate holes with the diameter of less than 1 μm.

On the contrary, when using electron lithography or ion beam lithography equipment, it is possible to make gate holes with the diameter of less than 1 μm, but improper to employ them for mass production of FED panels, since the electron beam and the ion beam scan the gate hole patterns one by one to form all gate hole pattern over the whole substrate, requiring a long time period.

As a solution to the above problems, a method for reducing the size of gate holes by using side-wall formation technique was disclosed [D. Stephani, D. Peters, W. Bartsch, C. A. Spindt, and C. E. Holland, IVMC '92, Program and Abstratcts, P. 8-4(1992)]. In this method, the first step is to form cathode, insulated layer and gate sequentially and to deposit the first sacrificial layer on them. Then, gate holes with the diameter of about 1 μm are formed by using the process of photolithography and the second sacrificial layer is deposited and dry-etched, reducing the diameter of the holes in the second sacrificial layer to about 0.4 μm and thus the gate electrodes are formed through etching process in which the second sacrificial layer is used as the etching mask.

SUMMARY OF THE INVENTION

The object of the present Invention lies in providing a method for forming minute gate holes with the diameter less than 1 μm uniformly, using a photomask alinger.

Another object of this Invention is to provide a method for fabricating field emitter arrays which can be driven with a lower voltage power supply.

To accomplish the foregoing objects of the present invention, there is provided a method for manufacturing a low voltage driven field emitter array, comprising the steps of: forming a thin thermal oxide layer on a silicon substrate; making a pattern with lots of silicon nitride masks on the thin thermal oxide layer; oxidizing further the upper part of the silicon substrate and forming a relatively thick oxide layer onto the silicon substrate except the part under the silicon nitride masks, during which the thick oxide layer upheaves the edges of the nitride masks and extends inwardly under the nitride masks so that the edges of the thick oxide layer under the nitride masks may have a kind of bird's beak shape in cross section; etching away the nitride mask pattern; exposing the silicon substrate for the circular parts surrounded by the bird's beak edges by etching away the thin oxide layer; etching away the exposed substrate for making gate holes of undercut shape; forming metal layers on the substrate and the bottom of the gate holes by evaporating a matallic evaporant downwardly and vertically against the surface of the substrate; and forming the field emission tips on the metal layers in the gate holes.

The cathode tips may be made by so called Spindt process.

Generally, A crystalline silicon wafer can be used as a substrate. A glass, a ceramic, or .a quartz plate, on which polycrystalline silicon or amorphous silicon is formed, my be used as a subtrate.

Further, the oxide layers may be formed by high temperature oxidation process, low temperature oxidation process, low temperature-high pressure oxidation process, or anodization of silicon and following low temperature oxidation of the resulting silicon.

Unlike the conventional methods to form gate holes after making the gate electrode layer, this invention adopts a method for fabricating field emitter arrays with submicron gate apertures by making gate holes smaller than those defined by photomask with a process that can reduce the size of gate holes in the step of forming the insulating layer. In other words, according to the present invention, the size of the gate holes in the insulating layer is reduced by means of local oxidation of silicon (LOCOS).

According to the invention, a new manufacturing process has been developed, which can make gate hole patterns on the substrate with the diameter of less than 1 μm and smaller than those formed by a photomask aligner, without using electron beam lithography or ion beam lithography equipment by reducing the sizes of gate holes by LOCOS technique, that is being used in the conventional semiconductor manufacturing process.

BRIEF DESCRIPTION OF THE DRAWINGS

The above objects and other advantages of the present Invention will become more apparent by the following detailed description of the preferred embodiment thereof with reference to the accompanying drawings, in which.

DETAILED DESCRIPTION OF THE INVENTION

Figure 1A:
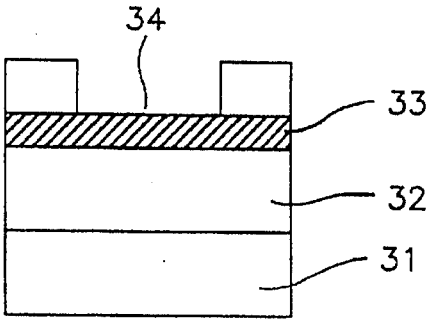
FIG. 1A–1E are cross-sectional views showing the steps of manufacturing a field emitter array by a conventional method (Spindt process)
Figure 1B:
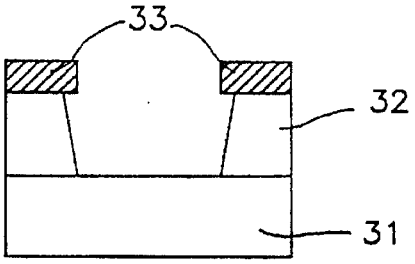
Figure 1C:
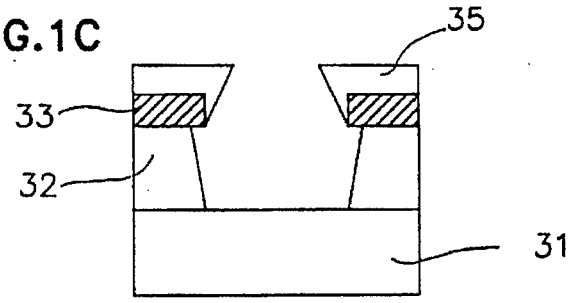
Figure 1D:
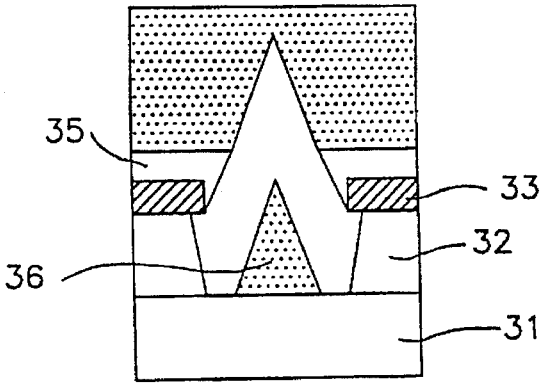
Figure 1E:
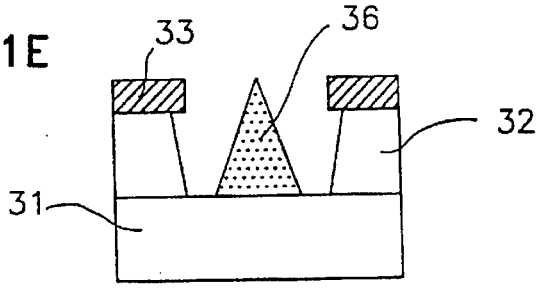

Hereinafter, the present Invention will be described in detail with reference to the accompanying drawings and in comparison with the conventional method.

The method for fabricating so-called Spindt-type field emitter is shown in FIG. 1. An insulating layer 32 is formed by thermal oxidation of the doped silicon wafer 31, and a gate electrode is made by depositing a metal layer 33 over the insulating layer 34. A pattern of minute gate holes 34 is formed by using the photolithography technique [FIG. 1 A].

Then, the parts of the metal layer and the insulating layer corresponding to the gate holes are sequentially etched so that a substrate with a section as shown in FIG. 1 B is formed. Parting layer is formed by mounting sililcon substrate on an electron beam evaporator and depositing the deposit material at a grazing angle on the surface of the substrate (FIG. 1. C). Next, a metal layer should get deposited so as for the deposit material to be vertically evaporated against the surface of substrate, the opening of the upper part of the gate holes 34 becomes gradually smaller and blocked, forming a space 40 therein and consequently, a cone-shaped field emitter tip 36 is formed, as metal is accumulated and deposited over the silicon substrate 31 at the bottom of the gate hole 34 and the parting layer 35 [FIG. 1 D].

Figure 2:
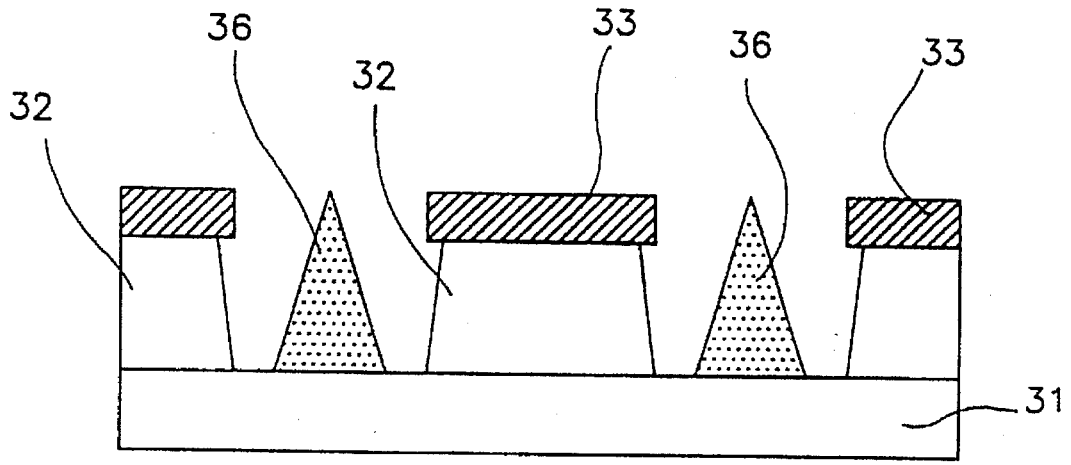
FIG. 2 is a cross-sectional view showing the shape of the conventional field emitter array.

Should only the parting layer 35 on the gate electrode 33 layer be selectively etched, the array with the configuration as shown in FIG. 1 E can finally be obtained with tip material (metal) on the parting layer 35 lifted off (Refer to FIG. 2).

Figure 3:
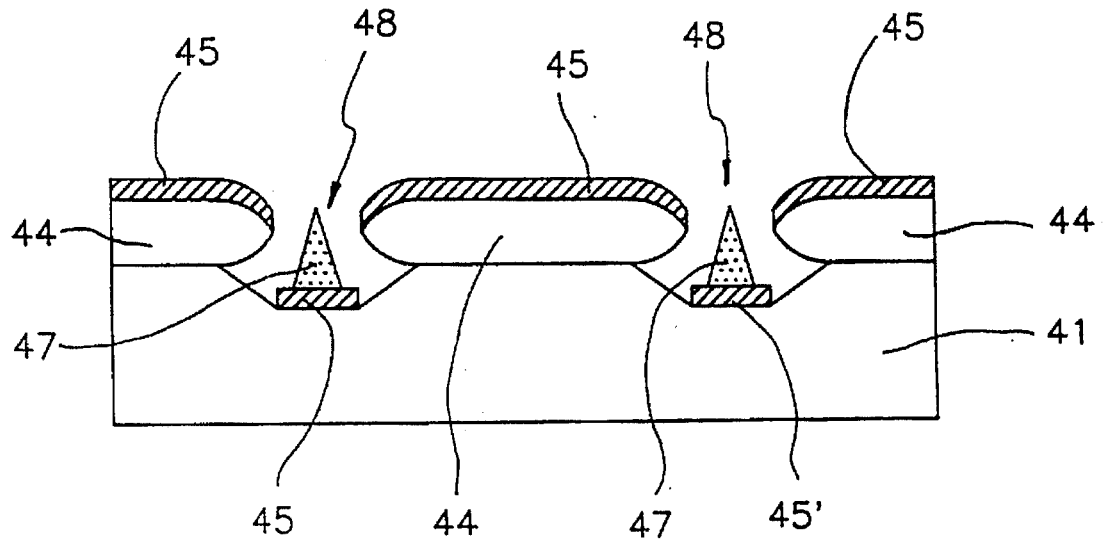
FIG. 3 is the cross-sectional view showing the shape of field emitter arrays according to the present Invention; and, FIG. 4A–4G are cross-sectional views showing the steps of manufacturing a field emitter array according to the embodiment of the present Invention.

FIG. 3 is cross-sectional view of the field emitter array according to the present invention, wherein the sizes of the gate hloes are shown as smaller than defined by the photomask.

FIG. 4A–FIG. 4G are cross-sectional views showing the steps of manufacturing a field emitter according to an embodiment of the present invention.

Figure 4A:
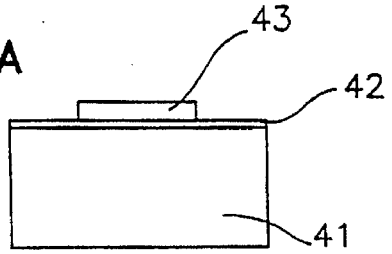

In FIG. 4A, a thin buffer layer 42 is formed on a doped silicon substrate 41, which is to function as the cathode electrode of the field emitter to be made, by means of thermal oxidation. Then, a silicon nitride layer with a certain thickness, for example 1,600Å, is deposited on the thermal oxide layer 42 so that the silicon nitride layer may have a role to protect the part of the silicon substrate under it from being oxidized during the following oxidation step. Silicon nitride mask pattern 43 with a diameter of 1.4 μm , for example, is formed by a photo-lithography process using the photomask aligner.

Figure 4B:
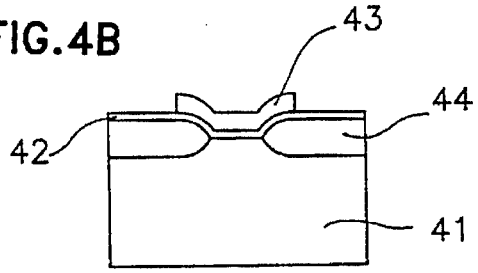
Figure 4C:
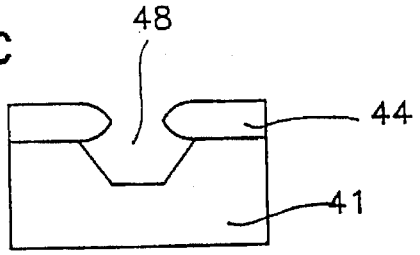

The silicon substrate 41 is then wet- or dry-oxidized at a high temperature to form an oxide layer onto the substrate 41 with an edge of bird's beak shape cross section at the part just under the edge of the nitride mask pattern. In this step, the buffer layer 42 upheaves the fringe or the edge of the nitride mask pattern 43, resulting in the cross section as shown in FIG. 4B. This oxide layer functions as an insulating layer 44 between the cathode and the gate, when the emitter operates electrically.

It may be noted that the distance or gap between the opposing edges of the insulating layer 44 is quite smaller than the diameter of the nitride mask pattern as the result of the above processes. The gap between the opposing edges of the insulating layer 44 is ultimately the diameter of the gate hole of the field emitter to be made, as will be described below.

The silicon nitride mask pattern 43 is removed by wet-etching and then, the upper part of the insulating layer 44 is etched away for the thickness as that of the buffer layer 42 to expose the silicon substrate 41 for the part between the opposing edges of the insulating layer or for the circle surrounded by the bird's beak edge. A gate hole 48 is formed without affecting the shape of the insulating layer 44 by wet- or dry-etching the silicon substrate 41 under the above exposed part thereof, as shown in cross section in FIG. 4C. In case of the dry-etching process, for example, it is preferable to use $SF_6$ gas with a low rf bias being applied for protecting the insulating layer 44 and making undercut shape of the gate hole 48.

Figure 4D:
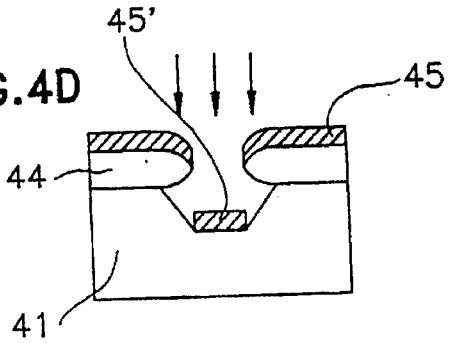
Figure 4E:
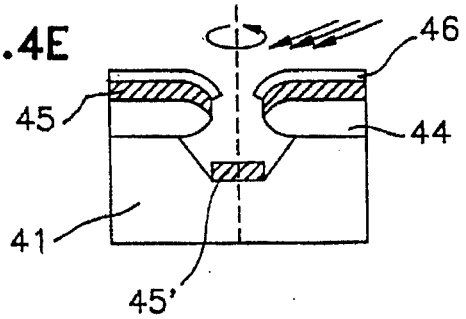

The silicon substrate 41 is mounted on an electron beam evaporator and a metallic evaporant is evaporated downwardly and vertically against its surface, forming metal layers 45 on the surface of the insulating layer except the underneath part thereof and 45' on the bottom of the gate hole 48 as shown in FIG. 4D. The evaporants or deposit materials may include molybdenum, niobium, chromium and hafnium, but are not limited to them. Thickness of the metal layer depends on the size of the gate hole 48.

Any conventional processes including the so-called Spindt process may be used for the remaining steps of fabricating the field emitter.

The steps for forming the field emission tip according to Spindt process are as follows;

Mount the silicon substrate 41 on an electron beam evaporator and deposit a parting layer 46 on the matal layer 45 through grazing incidence of a metal vapor such as aluminium, aluminium oxide or nickel (FIG. 4. E).

Figure 4F:
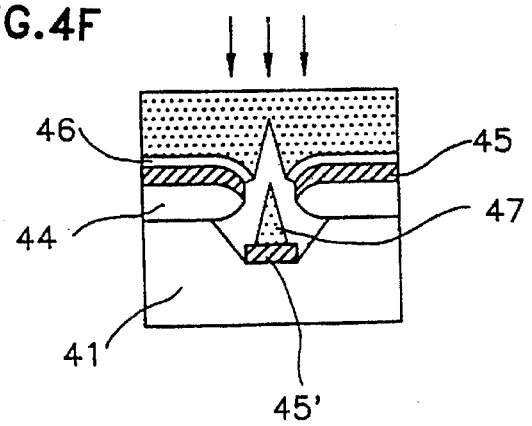

Form a cone inside the cavity 48 through a normal incidence of the metal evaporant such as molybdenum, niobium or hafnium (FIG. 4F). As the metal evaporant is also deposited on the parting layer 46 as well as on the metal layer 45' on the bottom of the cavity 48, the aperture closes or the gate hole is becoming smaller and the point of the cone 47 is formed.

Figure 4G:
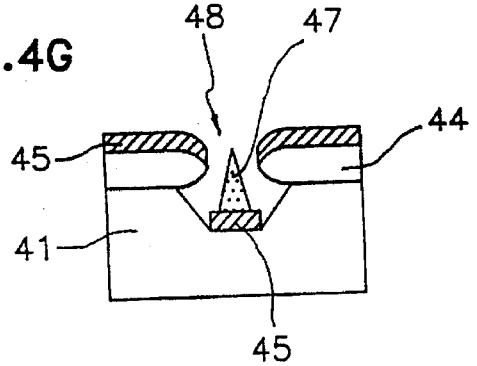

Etch off the parting layer 46 and thereby lift off the metal film deposited during the cone formation step, forming the shape of the field emission element shown in cross section as in FIG. 4G.

In this embodiment, as high temperatures of more than 900° C. is required for the encroaching oxidation, the doped silicon substrate may be replaced by the quartz substrate deposited thereon with doped polycrystalline silicon or amorphous silicon.

An ordinary plate glass may be used for curtailment of production cost by depositing thereon polycrystalline or amorphous silicon. In this case, it is desirable that the insulating layer 42 be formed by oxidation at low temperature and under high pressure, or by anodization of silicons to form porous silicon and oxidation of it at low temperature, in consideration of the low melting point of the ordinary glass.

According to the present invention, mass production of the field emitter arrays in a reduced size and a high density may be possible by using the conventional photomask aligner, as the same gate holes patterns with the diameter of less than 1 μm can repeatedly and uniformly be formed over the whole substrate for making the illeld emission elements.

Because the size of the field emission element of the present invention is extremely small, the driving voltage applied to between the gate and the cathode may be very low, for example, 10–30 volts and driving circuit of a field emitter display may be formed together on the same substrate as the field emission elements. As a result, any process for connecting the driver IC to the FED panel is not required and the production cost is saved.

Further, the reduced size of the field emitters makes it possible to consume less amount of metal and insulating materials and thus to bring about curtailment of production costs.

The field emitters made according to the present invention are of such extremely small size that they may be formed in a high packing density on the silicon substrate, and the area for accommodating the same number of pixels may relatively be reduced.

According to the present invention, the high resolution field emitter display panel of 4 inch×4 inch size substrate with 1,000×1,000 pixels can be made and applied to large scale displays of projection type requiring high resolution performance.

The present invention has been described as for examples, with respect to the preferred embodiments and variations and modifications may be made by one skilled in the art within the scope of the teaching of the present invention. It may be understood that the present invention is not limited by the specific embodiment herein, but shall be limited only by the claims.

What is claimed is:

1. A method for manufacturing a low voltage driven field emitter array, comprising the steps of:

forming a thin buffer layer on a silicon substrate;

making a pattern with a plurality of silicon nitride masks on said thin buffer layer;

selectively oxidizing the upper part of said silicon substrate to form a relatively thick oxide layer on said silicon substrate except on portions under said nitride masks, during which oxidation said thick oxide layer upheaves the edges of said nitride masks and extends inwardly under said nitride masks so that the edges of said thick oxide layer under said nitride masks develope a characteristic shape in cross section resembling a bird's beak;

etching away said nitride masks;

exposing said silicon substrate in circular regions surrounded by said characteristic shape edges by etching away said thin buffer layer;

etching away the exposed substrate for making gate holes of undercut shape;

forming metal layers on said substrate and on the bottom of said gate holes by evaporating a metallic evaporant downwardly and vertically against the surface of said substrate; and, forming the field emission tips on said metal layers in said gate holes.

2. A method for manufacturing a low voltage driven field emitter array as claimed in claim 1, wherein said silicon substrate is made of doped silicon.

3. A method for manufacturing a low voltage driven field emitter array, as claimed in claim 1, wherein said silicon substrate is made of polycrystalline silicon deposited on a glass, a ceramic, or a quartz plate.

4. A method for manufacturing a low voltage driven field emitter array, as claimed in claim 1, wherein said silicon substrate is made of amorphous silicon deposited on a glass, a ceramic, or a quartz plate.

5. A method for manufacturing a low voltage driven field emitter array as claimed in claim 1, wherein said oxide layers are formed by a high temperature oxidation process.

6. A method for manufacturing a low voltage driven field emitter array as claimed in claim 1, wherein said thick oxide layer is formed by a low temperature-high pressure oxidation process or by anodization of silicon to form porous silicon and subsequent oxidation of said porous silicon at low temperature.

* * * * *